US011647787B2

(12) United States Patent
Liu

(10) Patent No.: US 11,647,787 B2
(45) Date of Patent: May 16, 2023

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 298 days.

(21) Appl. No.: 17/013,891

(22) Filed: Sep. 8, 2020

(65) Prior Publication Data

US 2021/0186103 A1 Jun. 24, 2021

(30) Foreign Application Priority Data

Dec. 18, 2019 (CN) ..... 201922289461.6

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/40; A24F 40/485; A24F 40/10; A24F 40/42
See application file for complete search history.

(56) References Cited

U.S. PATENT DOCUMENTS

2018/0303162 A1* 10/2018 Zhang ..... A24F 40/485

FOREIGN PATENT DOCUMENTS

CN 111200942 * 5/2020
WO WO-2016112561 A1 * 7/2016 ..... A24F 47/002

* cited by examiner

*Primary Examiner* — Jean F Duverne
(74) *Attorney, Agent, or Firm* — Matthias Scholl P.C.; Matthias Scholl

(57) ABSTRACT

A clearomizer, including a seal plug, an e-liquid tank, a silicone base, a first silicone seal, a steel casing, and an atomization core. The seal plug is disposed on a first end of the e-liquid tank to seal an e-liquid inlet of the e-liquid tank. The silicone base is disposed on a second end of the e-liquid tank. The first silicone seal is disposed on one end of the atomization core. The atomization core passes through the silicone base and is fixed in the e-liquid tank. The steel casing is disposed on the second end of the e-liquid tank.

4 Claims, 5 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201922289461.6 filed Dec. 18, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an electronic cigarette.

A conventional electronic cigarette includes an atomization assembly and a battery assembly. The clearomizer for the atomization assembly is disposable and cannot be refilled with e-liquid. In addition, the vapor volume of a conventional electronic cigarette is unadjustable.

SUMMARY

The disclosure provides a clearomizer, comprising a seal plug, an e-liquid tank, a silicone base, a first silicone seal, a steel casing, and an atomization core; the seal plug is disposed on a first end of the e-liquid tank to seal an e-liquid inlet of the e-liquid tank; the silicone base is disposed on a second end of the c-liquid tank: the first silicone seal is disposed on one end of the atomization core; the atomization core passes through the silicone base and is fixed in the e-liquid tank: the steel casing is disposed on the second end of the e-liquid tank.

Also provided is an atomizer comprising the aforesaid clearomizer and an airflow regulator; the clearomizer is detachably disposed in the atomizer; the airflow regulator is disposed on one end of the atomizer.

The airflow regulator comprises a second silicone seal, a regulating seat, a seal ring, an airflow regulating ring, and a base; the second silicone seal is disposed in the regulating seat; the seal ring is disposed in a bottom of the regulating seat to seal the airflow regulating ring: the airflow regulating ring is disposed on the regulating seat; the base is disposed on the bottom of the regulating seat; the airflow regulating ring comprises a first side wall comprising a plurality of first air vents; the regulating seat comprises a second side wall comprising a plurality of second air vents; when in use, rotating the airflow regulating ring to selectively align the plurality of first air vents and the plurality of second air vents, thereby controlling an airflow volume of the atomizer.

Further provided is an electronic cigarette comprising an atomization assembly and a battery assembly; the atomization assembly comprises the atomizer.

The battery assembly comprises a battery having a capacity of 2200 mA·H.

The atomization assembly is disposed on the battery assembly. The base of the atomization assembly is in threaded connection to the threaded ring. The atomization assembly comprises a clearomizer which can be detached from the electronic cigarette for replacement. The e-liquid can be repeatedly injected to the clearomizer. The battery of the battery assembly is 24500 type and has a capacity of 2200 mA·H. Compared with a battery in the related art, the battery of the disclosure has a high power, and the electronic cigarette can produce much more heat and much more vapor.

DETAILED DESCRIPTION

To further illustrate, embodiments detailing an electronic cigarette are described below. It should be noted that the following embodiments are intended to describe and not to limit the disclosure.

Figure 1:
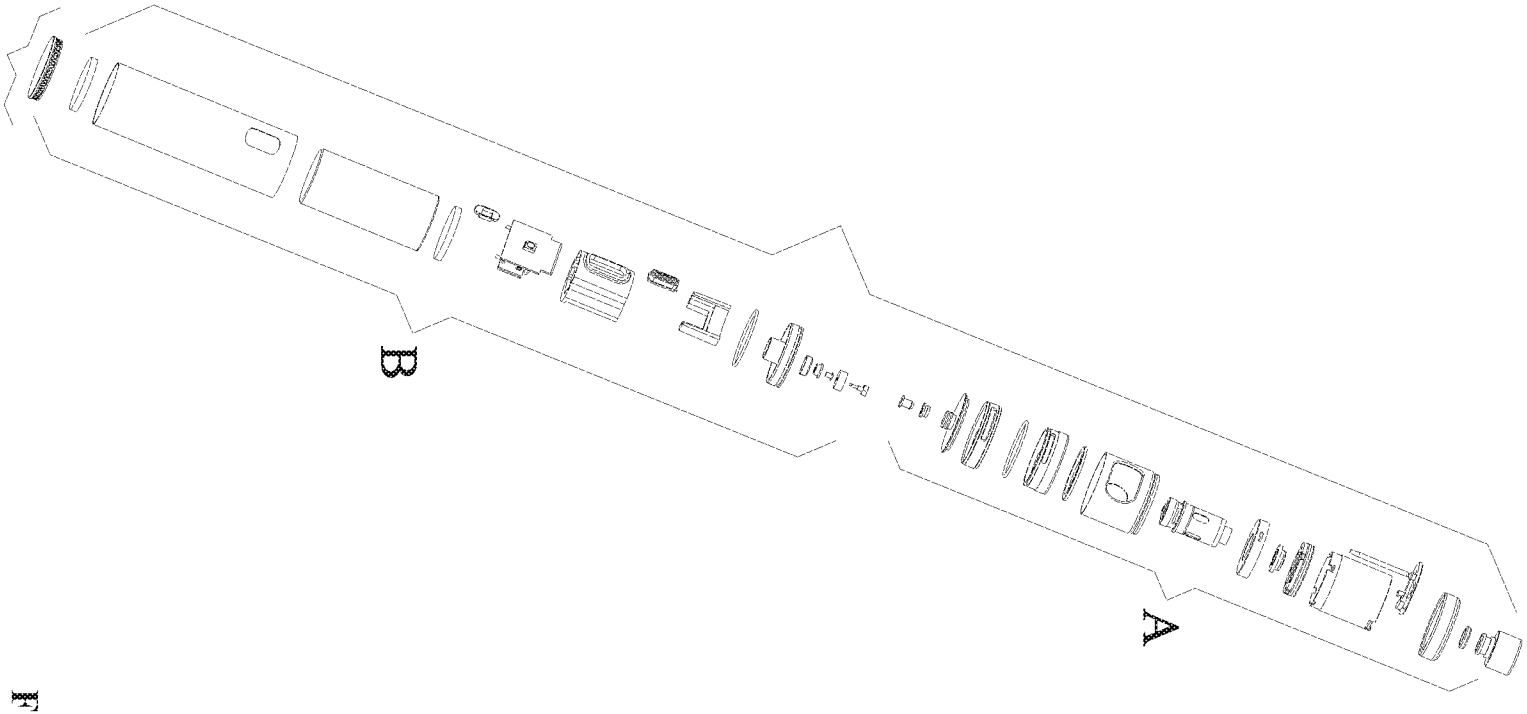
FIG. 1 is an exploded view of an electronic cigarette according to one embodiment of the disclosure.
Figure 2:
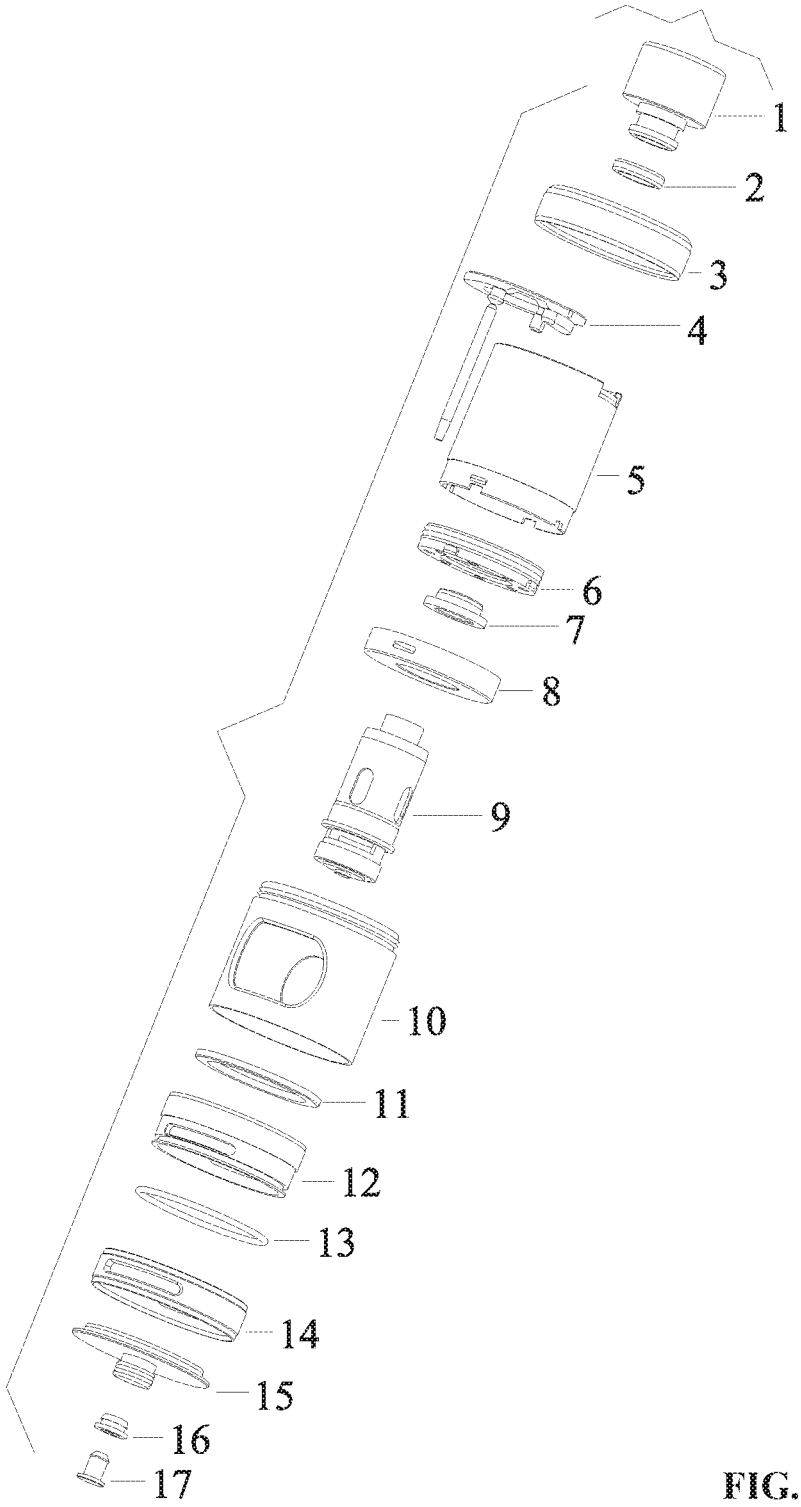
FIG. 2 is an exploded view of an atomization assembly of an electronic cigarette in FIG. 1.
Figure 3:
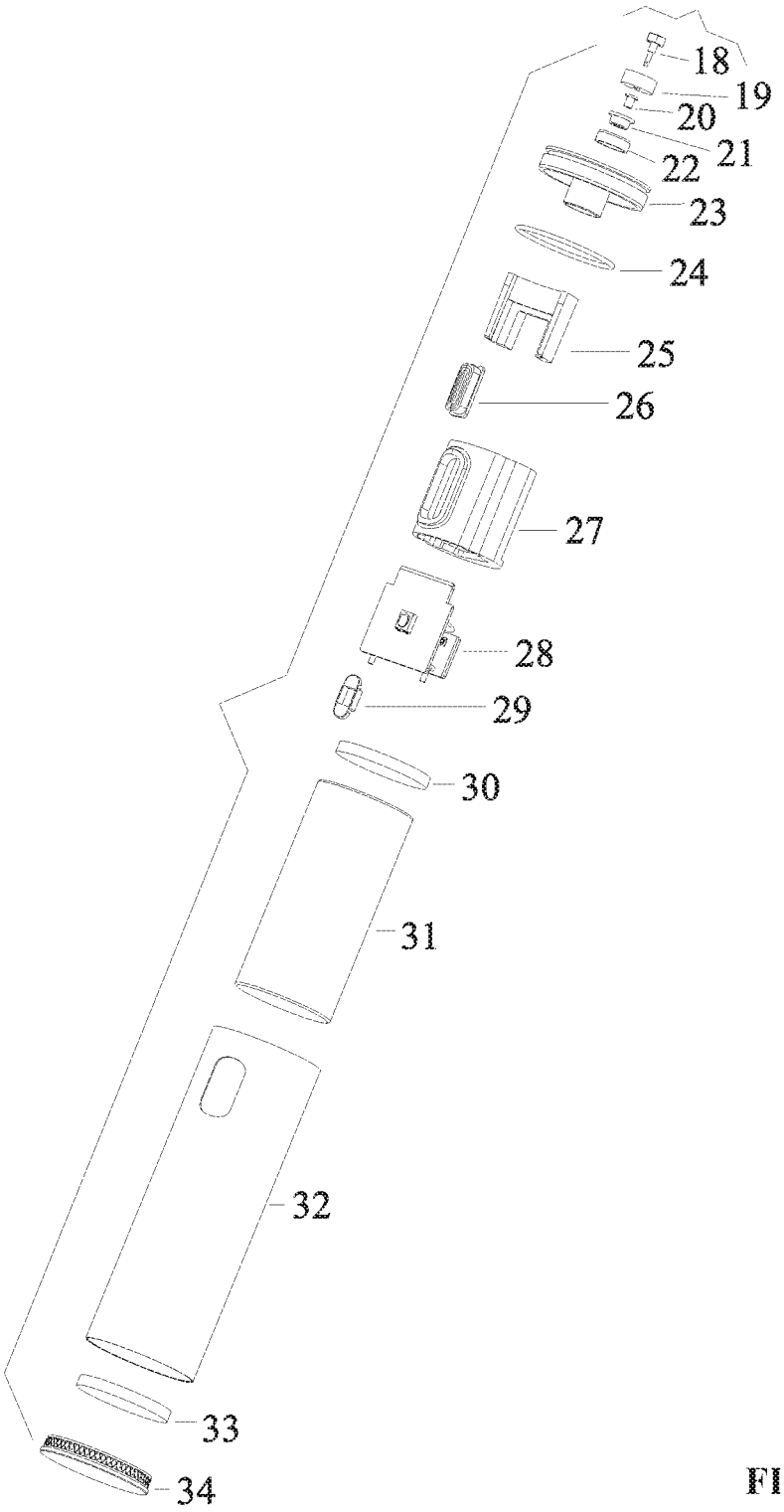
FIG. 3 is an exploded view of a battery assembly of an electronic cigarette in FIG. 1.
Figure 4:
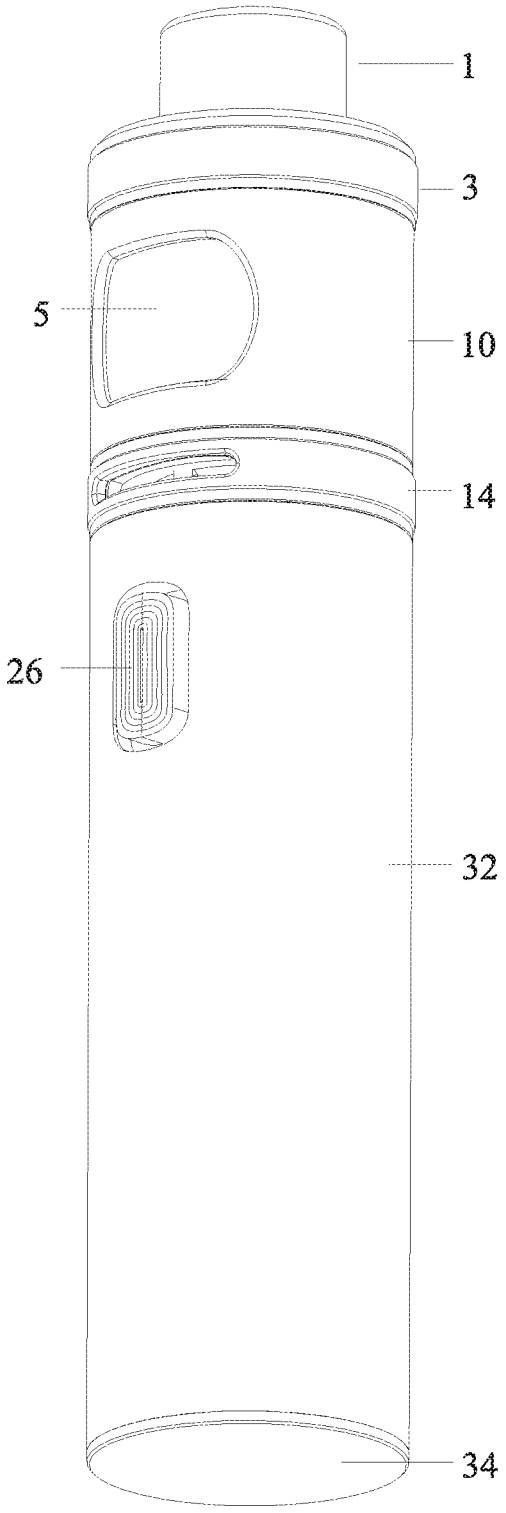
FIG. 4 is a schematic diagram of an electronic cigarette according to one embodiment of the disclosure.
Figure 5:
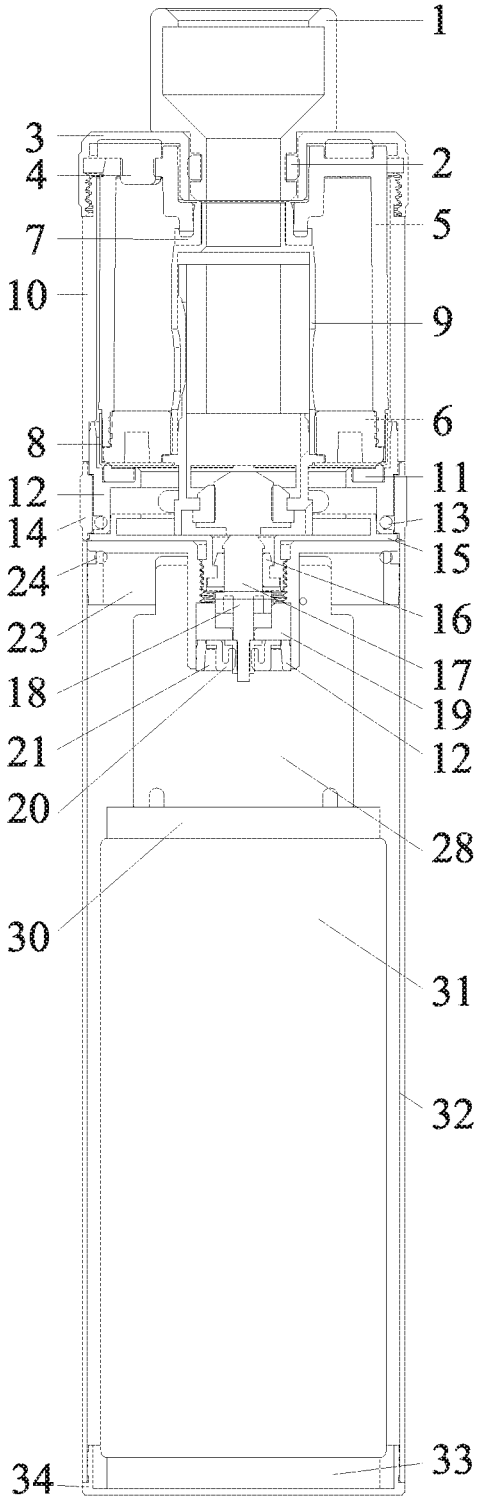
FIG. 5 is a sectional view of an electronic cigarette according to one embodiment of the disclosure.

As shown in FIGS. 1-5, the disclosure provides an electronic cigarette comprising an atomization assembly A and a battery assembly B.

The atomization assembly A comprises a mouthpiece 1, a mouthpiece seal 2, a mouthpiece support 3, a seal plug 4, an e-liquid tank 5, a silicone base 6, a first silicone seal 7, a steel casing 8, and an atomization core 9, an observation tube 10, a second silicone seal 11, a regulating seat 12, a first seal ring 13, an airflow regulating ring 14, a base 15, a first insulation ring 16, and a joint 17. The mouthpiece seal 2 is disposed on the mouthpiece 1 and the mouthpiece 1 is disposed on the mouthpiece support 3. The mouthpiece support 3 is disposed on the top end of the observation tube 10. The seal plug 4 is disposed on the top end of the e-liquid tank 5. The silicone base 6 and the steel casing 8 are consecutively disposed on the bottom end of the e-liquid tank 5. The first silicone seal 7 is disposed on the top end of the atomization core 9. The atomization core 9 is disposed in the silicone base 6. The e-liquid tank 5 is disposed on the observation tube 10. The first insulation ring 16 and the joint 17 are consecutively disposed on the base 15. The base 15 is disposed on the regulating seat 12. The second silicone seal 11 is disposed on the top end of the first seal ring 13 and the regulating seat 12 is disposed in a side groove of the first seal ring 13. The airflow regulating ring 14 is disposed around the regulating seat 12. The regulating seat 12 is disposed on the bottom of the observation tube 10.

The battery assembly B comprises an electrode 18, a second insulation ring 19, an elastic seat 20, a silicone joint 21, a fixed ring 22, a threaded ring 23, a second seal ring 24, a fastener 25, a button 26, a support 27, a control panel 28, a silicone gasket 29, a first ethyl vinyl acetate (EVA) gasket 30, a battery 31, a cartridge 32, a second EVA gasket 33, and a battery cover 34. The control panel 28 is disposed on the fastener 25. The fastener 25 is disposed on the support 27. The silicone gasket 29 is disposed on the button 26 and the button 26 is disposed on the support 27. The battery 31 is soldered on the control panel 28. The first EVA gasket 30 and the second EVA gasket 33 are respectively disposed on two ends of the battery 31, and the battery 31 together with the first EVA gasket 30 and the second EVA gasket 33 is disposed in the cartridge 32. The battery cover 34 is disposed on one end of the cartridge 32. The silicone joint 21 is disposed in the fixed ring 22, and the fixed ring 22 is disposed in the threaded ring 23. The electrode 18 is disposed in the second insulation ring 19, and the clastic seat 20 is disposed on the bottom part of the electrode 18. The electrode 18 is disposed in the threaded ring 23. The second seal ring 24 is disposed around the threaded ring 23. The threaded ring 23 is disposed on the top end of the cartridge 32. The atomization assembly A is disposed on the battery assembly B. The base 15 of the atomization assembly is in threaded connection to the threaded ring 23.

The battery of the battery assembly is 24500 type and has a capacity of 2200 mA·H. Compared with a battery in the related art, the battery of the disclosure has a high power, and the electronic cigarette can produce much more heat and much more vapor.

It will be obvious to those skilled in the art that changes and modifications may be made, and therefore, the aim in the appended claims is to cover all such changes and modifications.

What is claimed is:

1. An atomizer comprising a clearomizer and an airflow regulator; wherein:

the clearomizer comprises a seal plug, an e-liquid tank, a silicone base, a first silicone seal, a steel casing, and an atomization core; wherein the seal plug is disposed on a first end of the e-liquid tank to seal an e-liquid inlet of the e-liquid tank; the silicone base is disposed on a second end of the e-liquid tank; the first silicone seal is disposed on one end of the atomization core; the atomization core passes through the silicone base and is fixed in the e-liquid tank; the steel casing is disposed on the second end of the e-liquid tank;

the clearomizer is detachably disposed in the atomizer; the airflow regulator is disposed on one end of the atomizer.

2. The atomizer of claim 1, wherein the airflow regulator comprises a second silicone seal, a regulating seat, a seal ring, an airflow regulating ring, and a base; the second silicone seal is disposed in the regulating seat; the seal ring is disposed in a bottom of the regulating seat to seal the airflow regulating ring; the airflow regulating ring is disposed on the regulating seat; the base is disposed on the bottom of the regulating seat; the airflow regulating ring comprises a first side wall comprising a plurality of first air vents; the regulating seat comprises a second side wall comprising a plurality of second air vents; when in use, rotating the airflow regulating ring to selectively align the plurality of first air vents and the plurality of second air vents, thereby controlling an airflow volume of the atomizer.

3. An electronic cigarette, comprising an atomization assembly and a battery assembly; wherein the atomization assembly comprises the atomizer of claim 1.

4. The electronic cigarette of claim 3, wherein the battery assembly comprises a battery having a capacity of 2200 mA·H.

* * * * *